US009117576B2

(12) United States Patent
Oomen

(10) Patent No.: US 9,117,576 B2
(45) Date of Patent: Aug. 25, 2015

(54) WINDING SUPPORT, ELECTRICAL COIL AND METHOD TO PRODUCE AN ELECTRICAL COIL

(71) Applicant: Siemens Aktiengesellschaft, Munich (DE)

(72) Inventor: Marijn Pieter Oomen, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/256,041

(22) Filed: Apr. 18, 2014

(65) Prior Publication Data

US 2014/0312999 A1 Oct. 23, 2014

(30) Foreign Application Priority Data

Apr. 22, 2013 (DE) ..... 10 2013 207 222

(51) Int. Cl.

*H01F 6/00* (2006.01)
*H01F 5/02* (2006.01)
*H01F 41/02* (2006.01)

(52) U.S. Cl.

CPC .. *H01F 6/00* (2013.01); *H01F 5/02* (2013.01); *H01F 41/022* (2013.01); *H01F 2005/025* (2013.01)

(58) Field of Classification Search

CPC ..... H01F 27/06; H01F 27/28; H01F 27/29; H01F 27/30
USPC ..... 336/65, 196, 198
See application file for complete search history.

(56) References Cited

U.S. PATENT DOCUMENTS

| | | | | |
|---|---|---|---|---|
| 1,538,136 | A | 5/1925 | Prentiss et al. | |
| 8,178,473 | B2 * | 5/2012 | Hong et al. | 505/430 |
| 2003/0173103 | A1 * | 9/2003 | Morita et al. | 174/125.1 |
| 2013/0065767 | A1 | 3/2013 | Schauwecker et al. | |

FOREIGN PATENT DOCUMENTS

| | | | |
|---|---|---|---|
| DE | 2754221 | A1 | 6/1979 |
| DE | 3811749 | A1 | 10/1989 |
| DE | 102010042598 | A1 | 4/2012 |
| JP | 2000306736 | A | 11/2000 |
| WO | 2007004787 | A2 | 1/2007 |

OTHER PUBLICATIONS

"Persistent-Mode Operation of a Cryocooler-Cooled HTS Magnet," Koyanagi et al., IEEE Trans. On Applied Superconductivity, vol. 12, No. 1 (2002), pp. 476-479.

"Tesla-Class Quasi-Persistent-Mode HTS Magnet Excited by Thermoelectric Element," Tosaka et al., IEEE Trans. on Applied Superconductivity, vol. 18, No. 2 (2008), pp. 953-956.

* cited by examiner

*Primary Examiner* — Tuyen Nguyen

(57) ABSTRACT

A winding support has at least two parts on which to wind an electrical double coil in two winding planes situated in parallel, orthogonal to a winding axis. Each part has an annular structure with base areas that are identical for all of the parts, and an outer surface that is a band of the surface of a straight cylinder between the bases. Each part has a slit-shaped cut-out extending in a longitudinal direction over a portion of the length of the cylinder. The parts are adjacently connected with one another with a lateral separation therebetween in the direction of the winding axis, and with the cut-outs forming a common slit extending over both parts. An electrical coil has such a winding support, and a method to produce such a coil includes winding a conductor on such a winding support.

15 Claims, 11 Drawing Sheets

WINDING SUPPORT, ELECTRICAL COIL AND METHOD TO PRODUCE AN ELECTRICAL COIL

BACKGROUND OF THE INVENTION

1. Field of the Invention

The invention concerns a winding support for an electrical coil, and an electrical coil with such a winding support, as well as a production method for an electrical coil.

2. Description of the Prior Art

Superconducting coils are used to generate strong, homogeneous magnetic fields, with the superconducting coils being operated in a sustained short circuit current mode. For example, homogeneous magnetic fields with magnetic flux densities between 0.5 T and 20 T are required for nuclear magnetic resonance spectroscopy (MR spectroscopy) and for magnetic resonance imaging. These magnets are typically charged via an external current circuit and are then separated from the external power source since, in the resulting sustained short circuit current mode, a nearly lossless current flow occurs within the superconducting coil. The resulting strong magnetic field is particularly stable over time since it is not affected by the noise contributions of an external current circuit.

In known winding techniques for such coils, one or more superconducting wires are wound on support bodies, and different wire segments are maintained in contact with one another by wire connections with optimally low electrical resistance or via superconducting connections. For classical low-temperature superconductors such as NbTi and $Nb_3Sn$ with transition temperatures below 23 K, technologies exist to establish superconducting contacts to link wire segments and to connect the windings with a superconducting sustained current switch. The superconducting sustained current switch is thereby part of the electrical circuit of the coil and is placed in a resistive conductive state by heating, in order to inject an external current. After deactivating the heating and cooling down to the operating temperature, this part of the coil is also superconducting again.

High-temperature superconductors, also called high-$T_c$ superconductors (HTS), are superconducting materials with a transition temperature above 25 K, and above 77 K for some material classes, such as cuprate superconductors. For HTS, operating temperature can be achieved by cooling with cryogenic materials other than liquid helium. HTS materials are particularly attractive for the production of magnetic coils for MR spectroscopy and magnetic resonance imaging, because some materials have high upper critical magnetic fields of over 20 T. Due to the higher critical magnetic fields, the HTS materials are in principle better suited than the low-temperature superconductors for the generation of high magnetic fields (of over 10 T, for example).

One problem in the production of HTS magnetic coils is the absence of suitable technologies to produce superconducting HTS connections, in particular for second-generation HTS (known as 2G-HTS). The 2G-HTS wires are typically present in the form of flat twin-lead cables. If resistive contacts are introduced between the superconducting twin-lead cables, the losses in the coil can no longer be ignored and the generated magnetic field noticeably drops over a time period of a few hours or days (see IEEE Transactions on Applied Superconductivity", Vol. 12, No. 1, March 2002, Pages 476 to 479 and "IEEE Transactions on Applied Superconductivity", Vol. 18, No. 2, June 2008, Pages 953 to 956).

In DE 10 2010 042 598 A1, a superconducting MR magnet arrangement is described that has a superconducting twin-lead cable that is provided in the longitudinal direction with a slit between the two ends so that said superconducting twin-lead cable forms a closed loop surrounding the slit. In the magnet arrangement, the superconducting twin-lead cable is wound on at least one double coil made up of two sub-coils that are arranged rotated counter to one another so that they generate a predetermined magnetic field curve in a measurement volume. The winding disclosed in DE 10 2010 042 598 A1 can be designed as a freely supported coil body or as a coil winding on a winding support.

Known winding supports typically have the shape of hollow cylinders, for example with circular base areas (footprints), in which the coil winding is wound on the outer surface of the hollow cylinder with a predetermined winding tension. For applications in magnetic resonance systems, the inner space of the hollow cylinder remains free and forms an externally accessible volume for receiving an examination subject. In the coil arrangement disclosed in DE 10 2010 042 598 A1, the use of a conventional winding support is problematic because, in a conventional winding technique, one end of the twin-lead cable comes to lie on the winding support and is pressed firmly onto that winding support by the winding tension of the subsequent windings (turns). Such a mechanical fixing of the twin-lead cable end on the winding support prevents a mobility of the individual sub-coils counter to one another. Rotation of the coils relative to each other, however, is sometimes needed in order to generate a predetermined joint magnetic field curve, and such rotation is hindered or prevented by this conventional winding technique.

SUMMARY OF THE INVENTION

An object of the present invention is to provide a winding support that avoids the aforementioned disadvantages. An additional object of the invention is to provide an electrical coil with such a winding support, as well as a production method for such an electrical coil.

The winding support according to the invention has at least two parts for winding a double electrical coil in two winding planes parallel to one another, orthogonal to a winding axis. Each of the at least two parts has a structure with a base area that is the same for all of the parts, and an outer surface that forms a part of the surface between the opposite ends of a straight cylinder. Each of the parts has at least one slit-shaped cut-out that extends in a longitudinal direction over at least a portion of the length of the cylinder band. The at least two parts are connected or can be connected with one another so that they are arranged adjacently and laterally spaced from each other in the direction of the winding axis, and so that the cut-outs of the two parts are aligned to form a common slit extending across both parts.

As used herein, the term straight cylinder is used according to the generally accepted geometric definition, as meaning a body that is created by displacement of a flat base area along a straight line orthogonal to the base. The shape is thus not limited to a cylinder with circular base area. The winding planes of each sub-coil appropriately lie between the base areas of the cylinder of the respective part. The length of the respective cylinder portion is then accordingly its extent in the direction of the winding axis.

The at least two parts of the winding support according to the invention are either connected with one another or can be connected with one another so that they can be rotated together around the winding axis, so two sub-coils of a double coil can be simultaneously wound on the two parts. For example, the connection can be realized as a plug connection, as an adhesive connection or as a mechanical fixing on a common mount. Connecting parts (that may be present) are advantageously arranged on the inside of the annular parts. The connection of the two parts is advantageously designed so that they can be easily detached without damaging a coil winding applied onto the winding support due to the introduction of too much force. For example, a desired separation point can be provided between the two connected parts.

The winding support according to the invention enables the simultaneous winding of two sub-coils of a double coil, as well as the subsequent separation and modification of the mutual orientation of the two sub-coils. In particular, such a double coil can be formed from a loop-shaped, contiguous twin-lead cable.

The slit extending across both parts, through which slit one cable end of the loop-shaped twin-lead cable is slid and can be inserted into the inside of the winding support, is essential for this. After a separation of the two parts of the winding support, this free end enables a rotation and a flexible spatial orientation of the two sub-coils relative to one another.

The electrical coil according to the invention includes at least one winding support according to the invention and at least one twin-lead cable of doubly contiguous topology which is wound in the form of a double coil with two sub-coils each having the same number of coil windings. A sub-coil is respectively applied on a part of the winding support, and both sub-coils are oriented relative to one another so that magnetic fields generated by them given a current flow through the common twin-lead cable mutually reinforce.

The term "doubly contiguous" in geometric topology, is understood as meaning the twin-lead cable has the topology of a simple loop with a hole. For example, such a double contiguous twin-lead cable is generated by slicing a single contiguous twin-lead cable in the longitudinal direction, whereby two conductor branches are created that are connected together at both ends of the original cable.

An advantage of the electrical coil according to the invention is that a closed conductor loop is provided from a uniform material without additional electrical contacts needing to be achieved. An additional advantage is that the use of the winding support according to the invention enables the sub-coils to be oriented relative to one another flexibly so that they generate a desired magnetic field. For the generation of strong magnetic fields, it is necessary that the magnetic fields of the sub-coils mutually reinforce and do not mutually cancel out. After the common winding, this can be achieved by a rotation of the sub-coils counter to one another.

In the method according to the invention, a first cable end of a twin-lead cable of doubly contiguous topology is initially introduced into the slit of a first winding support according to the invention. Two cable branches of the twin-lead cable are subsequently wound on the first winding support, wherein the two parts of the first winding support are connected with one another during the winding, wherein each of the two cable branches is wound into a sub-coil on a part of the first winding support, and wherein both sub-coils are simultaneously produced via rotation of the first winding support around a common winding axis. Both sub-coils are subsequently separated from one another by separating the two parts of the first winding support from one another and subsequently spatially arranging them so that magnetic fields generated by them given a current flow through the common twin-lead cable mutually reinforce.

The advantages of the method according to the invention are analogous to the advantages of the winding support according to the invention and the coil according to the invention as described above. In particular, the introduction of a cable end of the twin-lead cable into the slit allows the later separation and flexible orientation of the sub-coils relative to one another. In the case of a circular winding geometry, the length of the cable end is advantageously at least as large as the inner diameter of the winding. For other winding geometries, it is advantageously at least as large as the smallest internal cross section of the winding. The length of the cable end inserted into the slit can advantageously be greater than ten times the width of the twin-lead cable. By the simultaneous winding, both sub-coils receive the same number of windings, and by the use of a uniformly thick twin-lead cable, they also receive the same winding height. Further additional method steps can be provided, for example an impregnation of the sub-coils with an impregnation agent or the casting of the sub-coils with a casting compound. After the arrangement of the sub-coils in the necessary spatial orientation, the sub-coils and the projecting ends of the twin-lead cable can be fixed, for example by casting, gluing or mechanical fixing with a mount. The inner end of the twin-lead cable is thereby advantageously guided out from the inner region of the winding support so that an optimally large portion of the internal space is free as a sample volume.

The winding support can accordingly additionally have the following features:

Each of the slit-shaped cut-outs of the at least two parts can have two first boundary surfaces that are situated orthogonal to the winding plane, travel essentially in parallel to one another and form an angle of at most 20 degrees with the respective cylinder casing at the outer surface of the respective part. By this formation of the cut-outs, a simple insertion of the twin-lead cable to be wound into the winding support is enabled, wherein the twin-lead cable is exposed to at most a slight buckling load. At the outer surface of the respective part, the first boundary surfaces particularly advantageously form an angle of at most 10 degrees with the respective cylinder casing.

The two first boundary surfaces can be curved surfaces that, at the outer surface of the respective part, form an angle of at most 10 degrees with the respective cylinder casing. The angle with the respective cylinder casing is particularly advantageously at most 5 degrees. The embodiment with curved first boundary surfaces enables the formation of a particularly flat slit with a particularly small angle relative to the outer surface of the parts, such that the twin-lead cable experiences a particularly small mechanical load upon insertion into the slit.

The outer surfaces of the at least two parts can both be situated on the casing of a common straight cylinder. The base area can be a surface with at least two-fold rotational symmetry. Base surfaces in the form of a circle, an ellipse, an oval, a racetrack geometry or a rectangle with rounded corners are particularly advantageous. Such a symmetrical design has the effect that two sub-coils produced with the aid of the winding support can be arranged adjacently again on a common base surface after a turning of one sub-coil.

In at least one of the parts, the slit-shaped cut-out can extend only over a portion of the height of the respective cylinder casing. This embodiment has the advantage that the portion of the cylinder height that is not affected by the cut-out forms an uninterrupted ring, such that the mechanical rigidity and contour accuracy of the part is increased in comparison to a completely open embodiment.

The at least two parts can have an extent of different size in the direction of the winding axis. The cylinder casing (that is provided by the two parts) thus then have a different height. This embodiment variant has the advantage that an asymmetrically cut twin-lead cable can be wound on the parts in registration. Such an asymmetrically divided winding support is thus particularly suitable for production of sub-coils of different widths. Sub-coils with different current carrying capability can thus be formed, for example for adaptation to local magnetic fields in a magnetic resonance apparatus, to generate predetermined inhomogeneous magnetic field distributions, and/or to maximize the total current depending on local conditions in a complex coil system from multiple magnetic coils.

At least one part of the winding support can be connected with an annular end piece whose base surface within the winding plane is larger than that of the associated part, and that is arranged on the side facing away from the adjacent part. Such an end piece projecting outward has the effect that a cable branch of the twin-lead cable that is wound on the associated part is kept axially outward. The lateral position of the windings is axially outwardly limited by the end piece, which leads to a greater geometric precision of the winding that is obtained. Such an end piece can be designed so that it can be removed again after winding of the coil so that it does not increase the axial space requirement of the coil. For example, the end piece can be removed before the curing of an impregnation agent of the coil, or before the casting with a casting compound.

At least one part can be connected with an annular middle piece whose base surface within the winding plane is larger than that of the associated part, and that is arranged on the side facing toward the adjacent part. Such a middle piece has the effect that a cable branch of the twin-lead cable that is wound on an adjacent part is kept axially inward. The lateral position of the windings is axially inwardly limited by the middle piece, which leads to a greater geometric precision of the winding that is obtained. One or more such middle pieces can be arranged between the two parts of the winding support. Such a middle piece can be designed similarly to the previously described end piece, such that it can be separated again from the part or from both parts after the winding of the coil.

The at least one middle piece of this embodiment can have at least one slit-shaped cut-out that, in a connected state of the two parts, together with the cut-outs of the two parts forms a common slit extending across both parts. The advantage of this embodiment lies in that a cable end of the twin-lead cable to be wound can be pushed through the middle piece and the two parts, into the inside of the winding support.

If the at least one middle piece has no such slit-shaped cut-out, the middle piece can alternatively be designed so that it is inserted between the parts only after the introduction of a cable end of the twin-lead cable from the outside into the slit of the two parts. For this, for example, the middle piece can comprise two half-rings that are assembled into one annular middle piece via insertion between the two parts.

The electrical coil according to the invention can additionally have the following features:

The coil can have at least two winding supports according to the invention and at least one twin-lead cable with doubly contiguous topology, and thus can comprise at least two pairs of sub-coils, in which the number of coil windings is respectively the same within a pair. A single doubly contiguous twin-lead cable can particularly advantageously be wound on two winding supports so that each of its two ends is pushed through the slit of a winding support, and a segment of the two contiguous cable branches of the twin-lead cable that is connected with this respective end is wound on the respective winding support. In this embodiment, a twin-lead cable is thus wound on four sub-coils that are simultaneously wound in pairs, and thus have the same winding height per pair.

As an alternative or in addition to this winding form, a twin-lead cable can also be wound on multiple winding supports so that non-terminal regions of the cable branches are not wound on separate winding supports. A coil can particularly advantageously comprise a twin-lead cable and four winding supports so that four symmetrical pairs of sub-coils are present, of which two pairs comprise twin-lead cable segments that are situated near the cable ends of a slit twin-lead cable and two pairs have twin-lead cable segments in the middle region of the slit twin-lead cable.

Multiple electrical coils according to the invention with multiple twin-lead cables can also be arranged in a common magnetic coil.

The twin-lead cable of doubly contiguous topology can be a slit twin-lead cable with a continuous superconducting layer. The superconducting layer is particularly advantageously a layer of a high-temperature superconductor, in particular a compound of the type $REBa_2Cu_3O_x$, wherein RE stands for a rare earth element or a mixture of rare earth elements. The continuous superconducting layer is connected in a superconducting manner across the entire contiguous loop without a link with a resistive contact existing.

The method according to the invention can additionally have the following steps: insertion of a second cable end of the twin-lead cable into the slit of a second winding support according to the invention, and winding a part of the twin-lead cable back on the second winding support according to the invention. A second pair of sub-coils is thereby formed that are separate from one another in the following and are spatially arranged so that magnetic fields generated by the sub-coils of the second pair given a current flow through the entire twin-lead cable mutually reinforce. This method allows a coil arrangement made up of two pairs of respective, simultaneously wound sub-coils to be produced in a simple manner.

Alternatively or additionally, the following steps can be provided: introduce a part of the twin-lead cable into the slit of a third winding support according to the invention, and winding of said twin-lead cable on the third winding support, wherein a third pair of sub-coils is formed that are subsequently separated from one another, and which pair is spatially arranged so that magnetic fields generated by the sub-coils of the third pairs given a current flow through the common twin-lead cable mutually reinforce. This embodiment of the method is particularly advantageously applied in combination with the previously described variants, in which a second cable end of the twin-lead cable is inserted into the slit of a second winding support. For example, in this way coil arrangements with four pairs of sub-coils are produced, of which two pairs are arranged near the ends of the slit twin-lead cable and two pairs are wound from middle segments of the slit twin-lead cable.

The production of such coil windings can particularly advantageously take place using twin-lead cables with continuous superconducting layers. The doubly contiguous, superconducting twin-lead cables can then advantageously be produced from a singly contiguous superconducting twin-lead cable, in that the cutting takes place with the aid of a laser or a saw, for example. Alternatively, the superconducting layer can be applied on an already slit substrate of the twin-lead cable.

DESCRIPTION OF THE PREFERRED EMBODIMENTS

Figure 1:
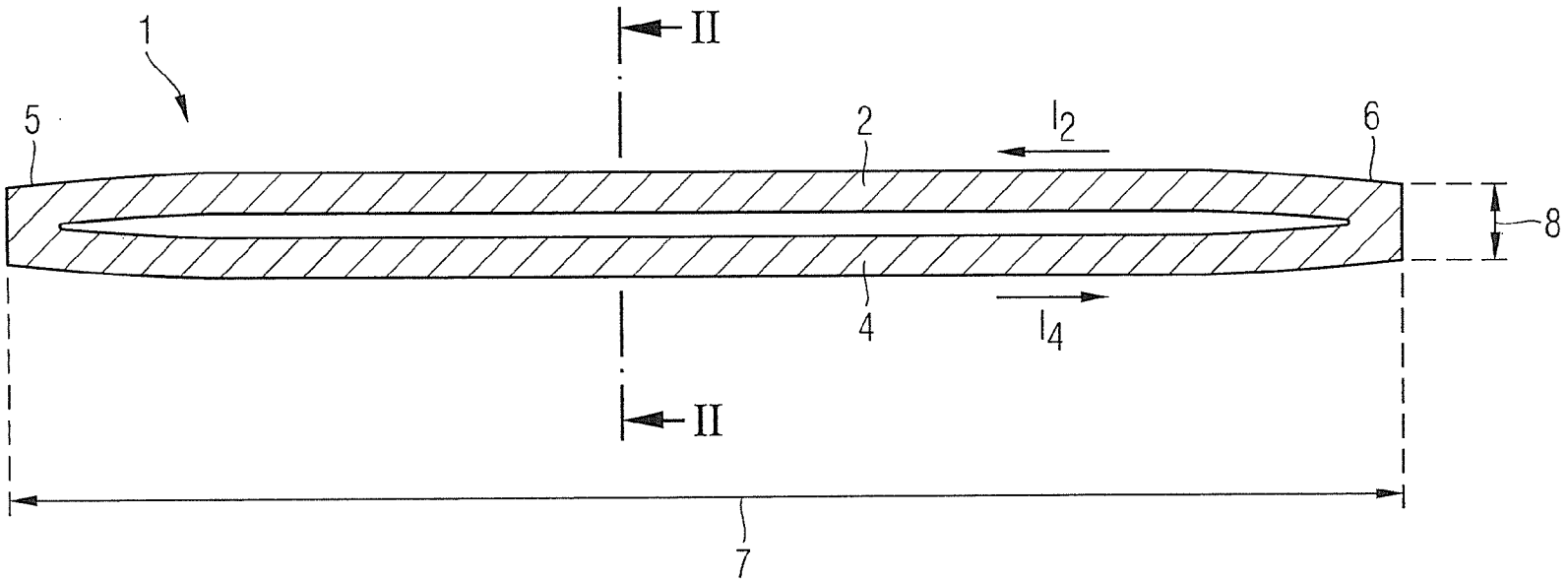
FIG. 1 is a schematic plan view of a superconducting twin-lead cable having doubly contiguous topology.

FIG. 1 is a schematic plan view of a superconducting twin-lead cable having doubly contiguous topology. This twin-lead cable is produced by slitting a single, contiguous superconducting twin-lead cable. In this example, the slitting takes place by means of a laser.

A first exemplary embodiment of the invention describes a magnetic coil for NMR spectroscopy. In this example, the length 7 of the original singly contiguous twin-lead cable is 1000 m. However, this length can also be significantly shorter or longer. In a magnetic coil for magnetic resonance imaging, the length can be a multiple of the length described here. The superconducting twin-lead cable comprises two approximately identically dimensioned cable branches 2 and 4. A current $I_2$ flows through the first cable branch 2, and a current $I_4$ flows in the opposite direction through the second cable branch, such that a closed ring current flows through the complete doubly contiguous superconducting twin-lead cable 1. In this example the width 8 of the original, singly contiguous twin-lead cable is 10 mm, and the width of the two cable branches 2 and 4 in the slit region is respectively 5 mm. Depending on the twin-lead cable material that is used, however, this width of the cable branches 2, 4 can also turn out to be greater or smaller; in particular the twin-lead cable 1 can also be divided asymmetrically. The two cable branches 2 and 3 remain connected in the region of the two cable ends 5 and 6.

Figure 2:
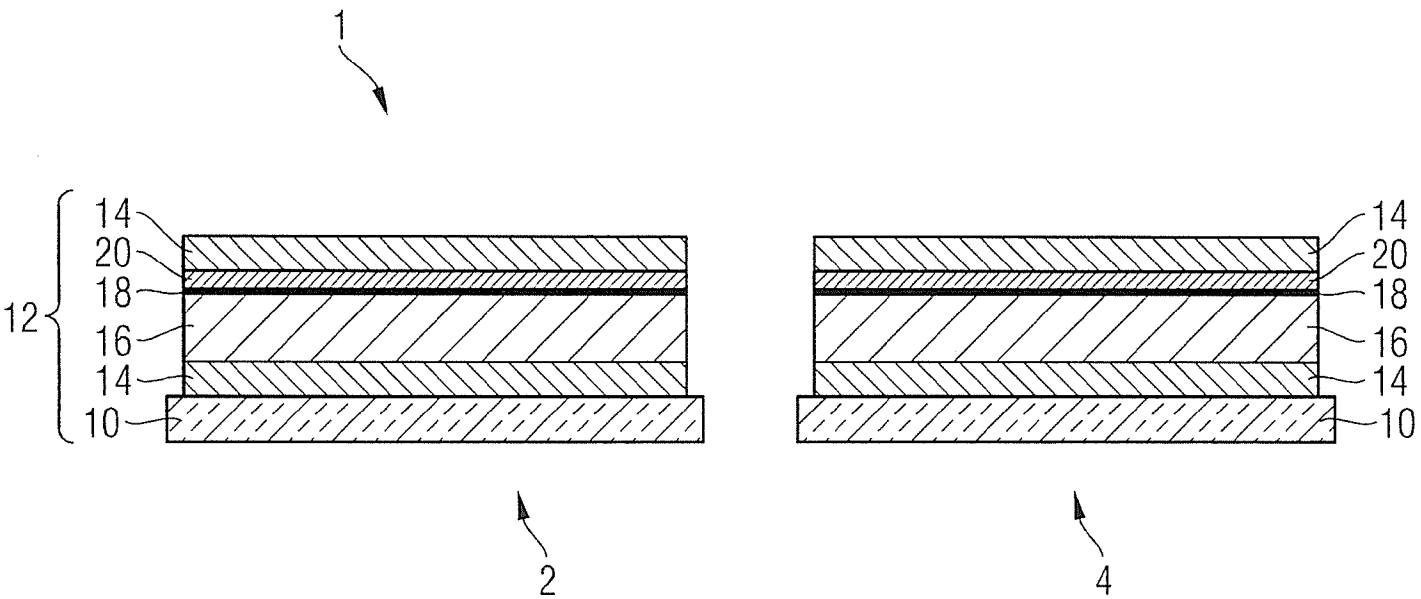
FIG. 2 is a cross section of the superconducting twin-lead cable according to the section plane II in FIG. 1.

FIG. 2 shows an exemplary cross section of a superconducting twin-lead cable with a high-temperature, second-generation superconductor in which the layer structure is schematically depicted. In this example, superconducting twin-lead cable 1 comprises an insulating layer 10 with which it is permanently connected to a winding band 12. In this example, the insulating layer is a 50 μm thick Kapton band; however, it can also be constructed from other insulating materials, for example other plastics. The winding band 12—which is likewise doubly contiguous—encloses the two cable branches 2 and 4 that are situated next to one another, wherein the entire winding band 12 with these cable branches 2 and 4 situated next to one another is rolled on a storage roll (not shown here), and the coil device is produced by unwinding the doubly contiguous winding band 12 from the storage roll. Over the insulating layer 10, the layer structure of each cable branch 2, 4 initially comprises a normally conductive cover layer 14 that, in this example, is a 20 μm-thick copper layer. Following this is the support band 16, which here is a 50 μm-thick substrate made of a nickel-tungsten alloy. Steel bands or bands made of an alloy (for example Hastelloy) can also be used. A 0.5 μm-thick buffer layer 18 that includes the oxidic materials $CeO_2$ and $Y_2O_3$ is arranged over the support band 16. Following past this is the actual superconducting layer 20, here a 1 μm-thick layer made of $YBa_2Cu_3O_x$ that is in turn covered with a 20 μm-thick cover layer 14 made of copper. The superconducting layer 20 forms a contiguous layer over the entire doubly contiguous topology. In the shown example, in each cable branch 2, 4 the width of the insulating layer 10 is somewhat greater than the width of the remaining layers 14 through 20, such that cable branches 2, 4 that come to lie atop one another given a winding of the coil device are reliably insulated from one another. As an alternative to the shown example, insulating layers 10 can also be arranged on both sides of the superconducting twin-lead cable 1, or the lateral regions of the superconducting twin-lead cable 1 can also be protected by insulating layers. Furthermore, it is possible to plait an insulating layer as a separate band into the coil device only in the production of the coil winding.

Figure 3:
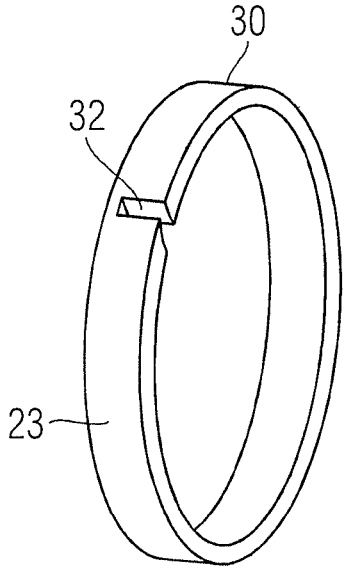
FIG. 3 is a schematic, three-dimensional view of a part of a winding support.

FIG. 3 shows a schematic, three-dimensional depiction of a first part 23 of a winding support 22 according to the invention according to a first exemplary embodiment of the invention. The first part 23 has an outer surface 30 that is situated on the casing of a straight circular cylinder. Alternatively, the base area of the cylinder can have a different shape, for example the shape of an oval or a racetrack coil. The first part 23 is provided with a slit-shaped cut-out 32 that extends over a portion of the height of the cylinder casing, such that the annular part 23 forms a closed ring on a remaining partial region.

Figure 4:
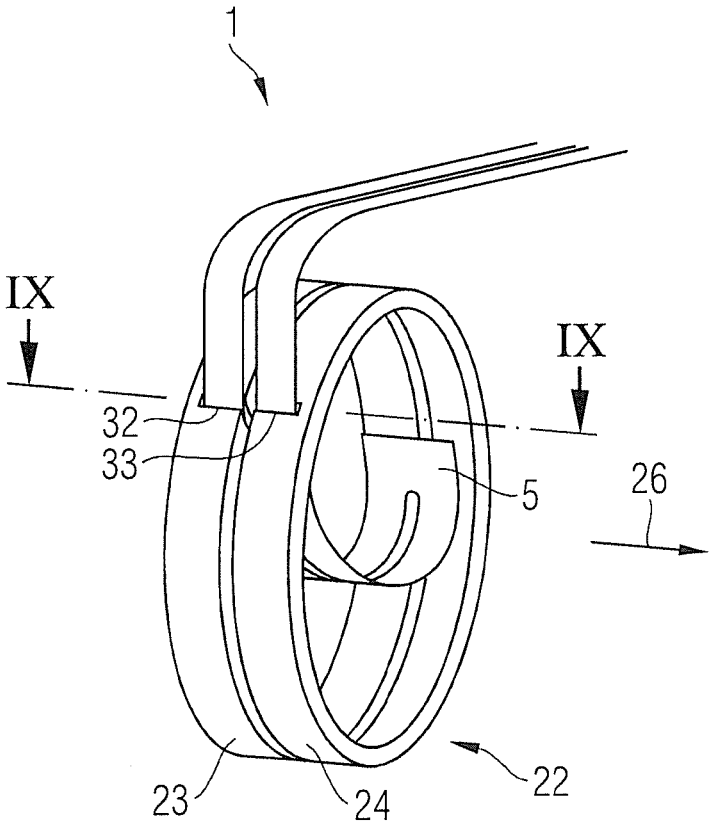
FIG. 4 shows a winding support according to a first exemplary embodiment.

FIG. 4 shows a winding support 22 according to a first exemplary embodiment of the invention, in which two symmetrical parts 23 and 24 are arranged so that their recesses 32 and 33 form a contiguous slit extending across both parts 23 and 24. Both parts 23, 24 are arranged laterally offset relative to a winding axis 26 and are mechanically connected with one another so that they can be rotated together around the winding axis. FIG. 4 schematically shows a first step of a production method of an electrical coil in which a cable end 5 of a superconducting twin-lead cable 1 is introduced into the adjacently arranged slit-shaped cut-outs 32, 33.

Figure 5:
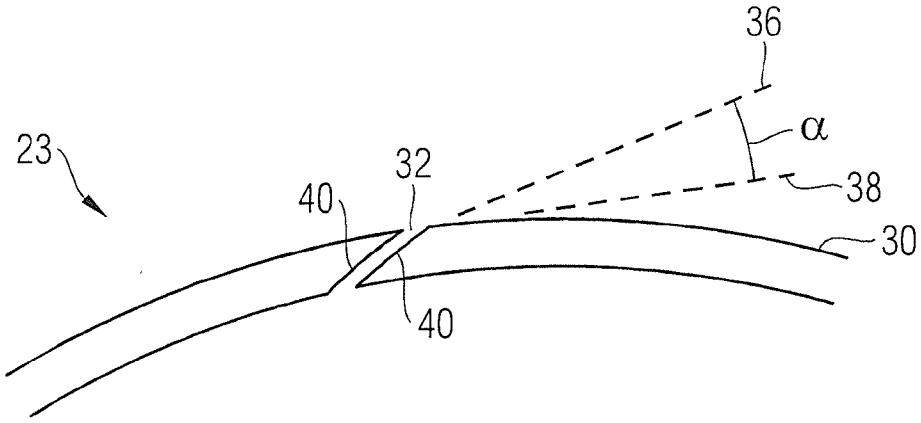
FIG. 5 is a detail view of the cut-out of a part.

FIG. 5 shows a schematic detail view of the cut-out 32 of a part 23. A cross section is shown within the winding plane of the coil winding to be wound on this part. The cut-out 32 has two first boundary surfaces 40 that lie orthogonal to the winding plane of the coil winding, thus orthogonal to the section plane shown here. At the outer surface 30 of the part, the boundary surfaces 40 have an angle α of at most 20 degrees with the cylinder casing of the outer surface 30, as is schematically indicated in FIG. 5 by the angle α between the tangent 38 of the cylinder casing and the continuation 36 of the entrance area. A slight curvature of the boundary surfaces 40 toward the center of the winding support allows the cut-out 32 to penetrate the wall thickness of the part 23 with a small spatial extent, in spite of the flat entrance angle.

Figure 6:
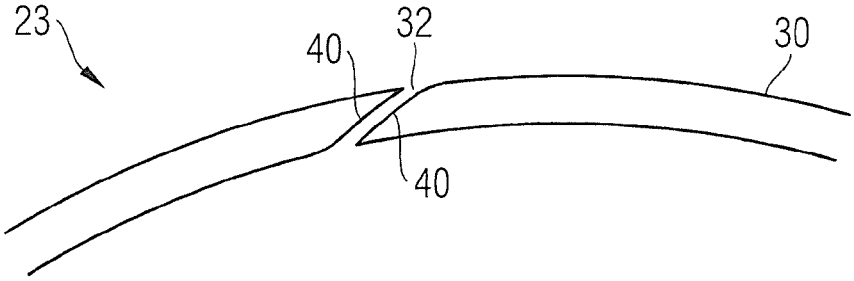
FIG. 6 is a detail view of an alternatively shaped cut-out of a part.

FIG. 6 schematically shows an alternative embodiment of the cut-out 32 of the part 23. Here the boundary surfaces 40 of the cut-out 32 are curved so that an adaptation to the curvature of the part is achieved both on the inside and on the outside of the hollow cylindrical part 23. For this purpose, the curvature of the boundary surfaces 40 changes in a middle region of the thickness of the cylinder wall, whereby a slit is formed with a slightly s-shaped cross section. It is hereby achieved that a twin-lead cable 1 pushed through the slit can be applied both on the inside and on the outside 30 of the surface of the part 23 without being flexed significantly.

Figure 7:
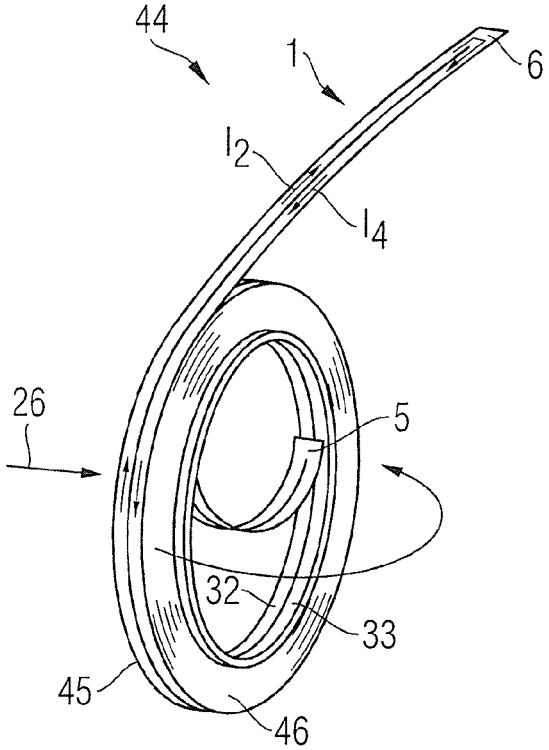
FIG. 7 is a schematic, three-dimensional view of a wound electrical coil.

FIG. 7 shows a schematic, three-dimensional view of a wound electrical coil according to the first exemplary embodiment of the invention. In FIG. 7, the majority of the twin-lead cable 1 is wound on the winding support 22 in the form of a double coil, such that—in addition to the second cable end 6—only a small partial segment of the twin-lead cable 1 remains outside of the coil winding, which small partial segment is comparable in length to the portion of the twin-lead cable 1 that is pushed inwardly through the cut-outs 32, 33. By simultaneous rotation of the two parts 23, 24 around the winding axis 26, two symmetrical sub-coils 45 and 46 have been formed on the winding support 22, the winding planes of which sub-coils 45 and 46 are situated parallel to one another and are arranged closely adjacent to one another. Given a ring-shaped current flow through the doubly contiguous twin-lead cable 1, an opposite current flow $I_2$, $I_4$ would occur through the two cable branches 2 and 4 without additional measures. The magnetic fields that are thereby generated would thus have opposite field directions. In order to generate mutually reinforcing magnetic fields, the sub-coils 45 and 46 must be rotated starting from the arrangement in FIG. 7.

Figure 8:
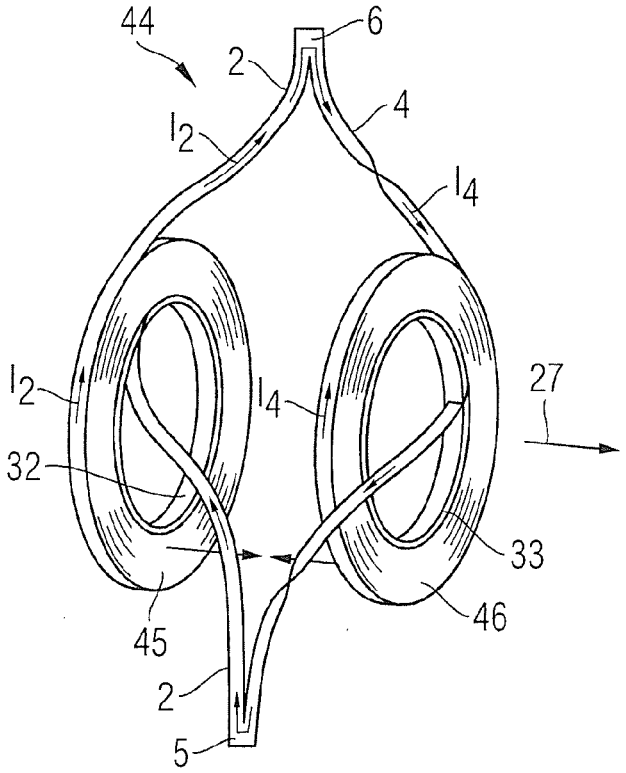
FIG. 8 is a schematic view of an electrical coil with sub-coils oriented according to the invention.

An arrangement of an electrical coil 44 in which the sub-coil 46 has been rotated counter to the sub-coil 45 is schematically shown in FIG. 8, such that now a current flow 12 and 14 in the same direction is achieved and the magnetic fields of the sub-coils 45, 46 mutually reinforce. For this, the twin-lead cable 1 must be slightly rotated in the region of the free cable ends 5, 6. These free cable ends can be fixed via suitable measures (such as adhesion or mechanical retention) so that they are not damaged by strong Lorentz forces, for example. The inner cable end 5 is preferably arranged so that an optimally large portion of the inner space of the electrical coil 44 remains free as a sample volume. The sub-coils 45 and 46 can be arranged even more significantly closer to one another than is indicated in FIG. 8. An optimally high packing density of individual coil windings a system axis 27 is desirable for the generation of very high magnetic fields. Given the electrical coil 44, the minimum spacing of the two sub-coils 45 and 46 is provided in that a cable branch 2 must travel through between the two sub-coils 45, 46 in the region of the inner twin-lead cable end 5. Depending on the orientation of this segment of the cable branch 2, a minimum spacing of the two sub-coils 45, 46 is thus provided by the width and/or thickness of a cable branch 2.

To inject a current, the electrical coil 44 here can additionally comprise contacts (not shown) to connect the coil with an external power source. Moreover, the electrical coil 44 can comprise a heatable region that can be placed into resistive conductive state via heating. Two contacts can be appropriately arranged in the region of one of the cable ends 5 to 6 so that they are arranged on both sides of the heatable region of the coil. An external current can then be injected into the coil via the contacts while the heatable region is in a resistive conductive state due to the heating.

The selection of the material for the winding support 22 depends on whether the wound coil remains on the coil support during its operation, or whether it is separated from the winding support after winding. In the cases in which the coil remains on the winding support, for example, the material of the winding support can comprise fiberglass-reinforced plastic, stainless steel, aluminum, and/or alloys with stainless steel and/or aluminum.

Figure 9:
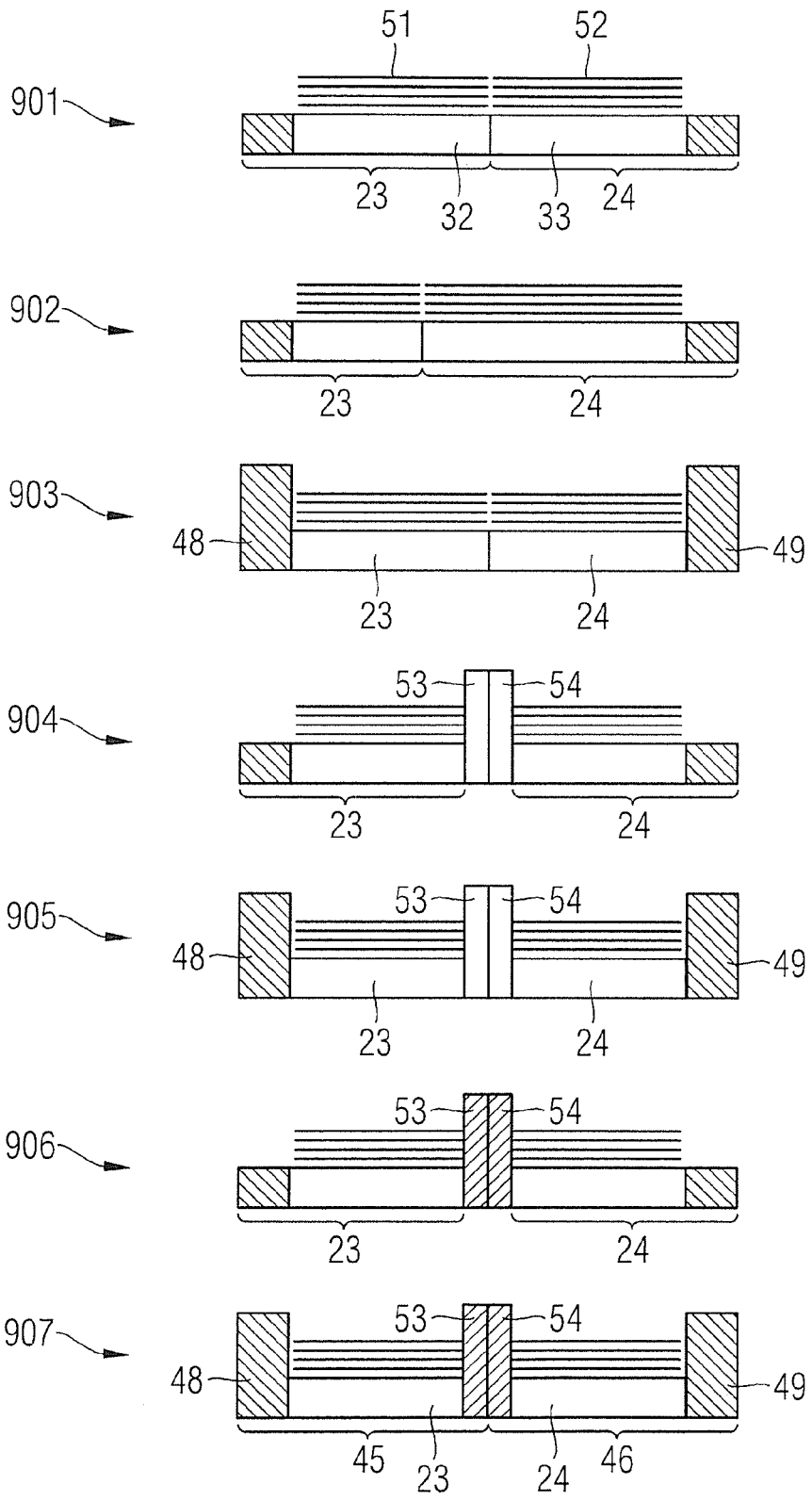
FIG. 9 shows schematic cross sections of different embodiments of winding supports.

FIG. 9 shows schematic cross sections of different embodiments of winding supports 901 through 907. For the previously described first exemplary embodiment, the cross section corresponds to the section plane IX that is shown in FIG. 4 in the region of the cut-outs 32, 33. Each of the winding supports 901 through 907 includes two parts 23, 24 that are provided with slit-shaped cut-outs 32, 33 in an inner region. Given the winding support 901 of the first exemplary embodiment, the cut-outs 32, 33 extend only over a portion of the height of the cylinder casing, such that ring-shaped contiguous segments are present in the outer regions of the parts. In FIG. 9, the segments that are contiguous over the periphery are generally designated with shading, while the segments affected by the cut-outs are reflected by open structures. On the inner regions of the parts 23, 24 that are provided with cut-outs 32, 33, the two partial windings 51 and 52 are situated in a number of layers of the twin-lead cable 1.

Figure 10:
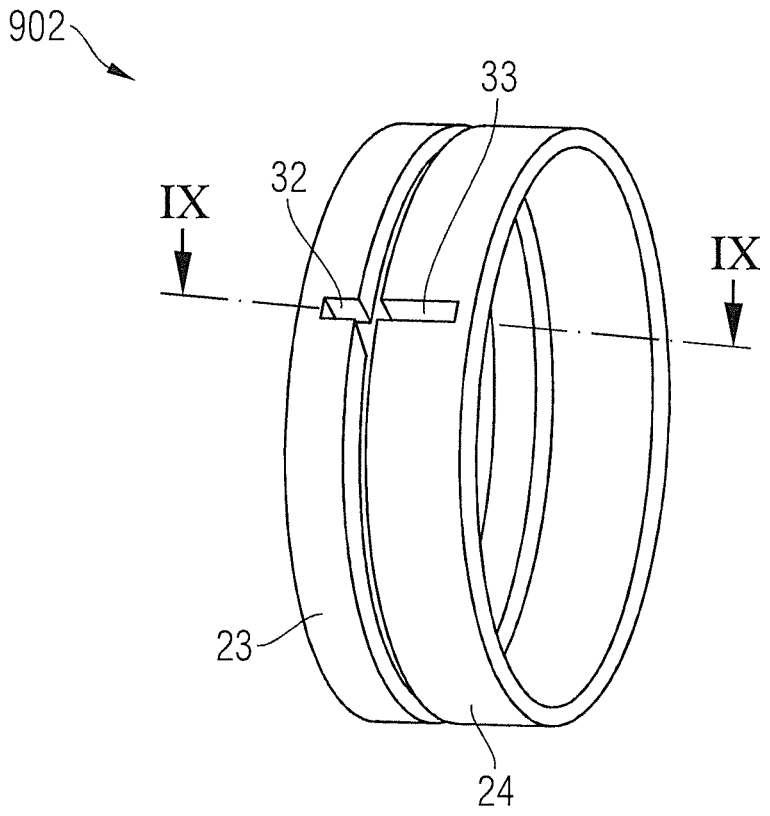
FIG. 10 is a schematic, three-dimensional view of a winding support according to a second exemplary embodiment of the invention.

In a second exemplary embodiment of the winding support 902, the two parts 23, 24 are designed to have different widths so that a double coil with partial windings of different width are created given a winding of two sub-coils 45, 46 with an asymmetrically slit twin-lead cable. A three-dimensional, schematic depiction of such a winding support 902 according to the second exemplary embodiment is shown in FIG. 10, In a third exemplary embodiment of the winding support 903, the parts 23, 24 are respectively provided on the outside with annular end pieces 48, 49 whose base area is larger than that of the associated parts. Sub-coils 51, 52 attached to the two parts 23, 24 are outwardly limited by the two end pieces 48, 49, which leads to a precise spatial positioning upon winding. The end pieces 48, 49 are not provided with cut-outs.

In a fourth exemplary embodiment of the winding support 904, the parts 23, 24 are respectively provided on the inside with annular middle pieces 53, 54 whose base area is larger than that of the associated parts. Sub-coils 51, 52 attached to the two parts 23, 24 are inwardly limited by the two middle pieces 53, 54, which again leads to a precise positioning upon winding.

Figure 11:
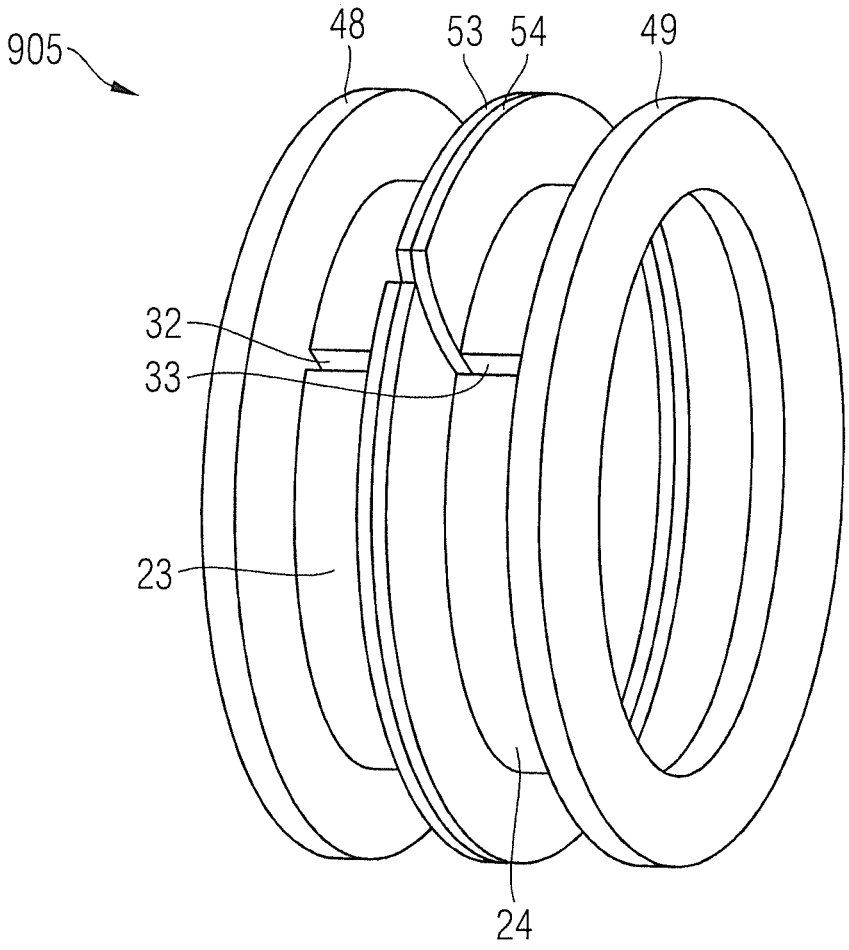
FIG. 11 is a schematic view of a winding support according to a fifth exemplary embodiment of the invention.
Figure 12:
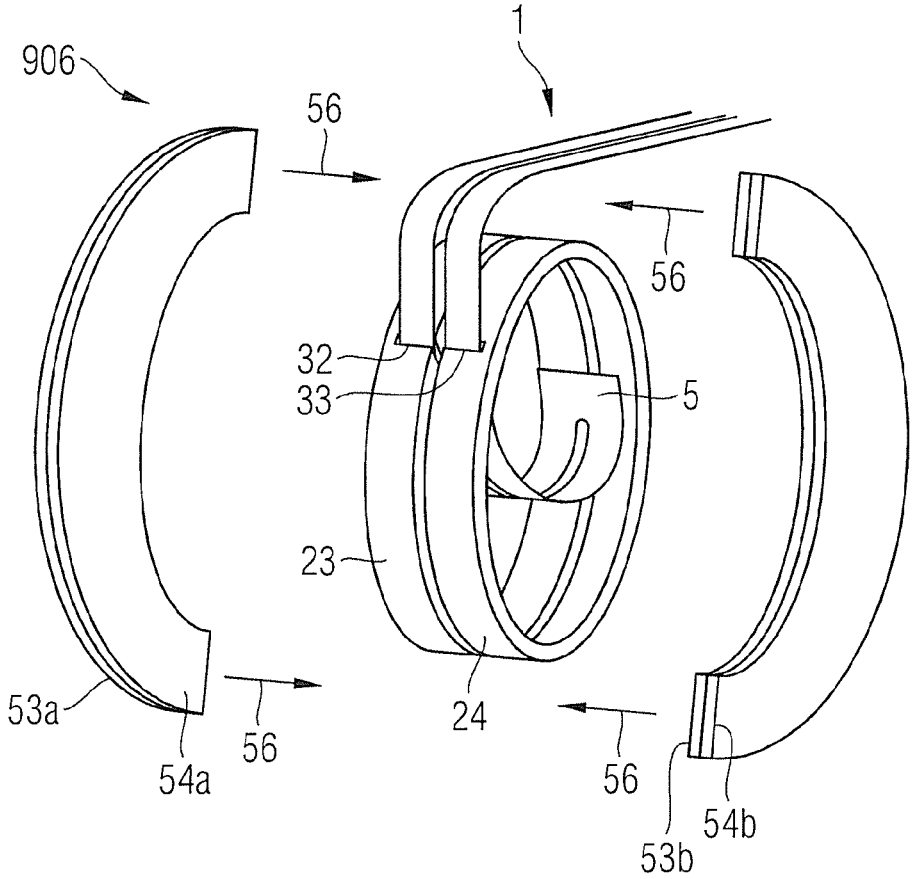
FIG. 12 is a schematic view of a winding support according to a sixth exemplary embodiment of the invention.

The winding support 905 according to a fifth exemplary embodiment, in which both outer end pieces 48, 49 and inner middle pieces 53, 54 are connected with the respective parts, is particularly advantageous. In this way, the partial windings 51, 52 are held in the desired positions on both sides. In both the fourth and fifth exemplary embodiment, the middle piece 53, 54 of the winding support 904, 905 are likewise provided with cut-outs that, together with the cut-outs 32, 33 of the parts 23, 24, form a contiguous slit. As schematically depicted for the fifth exemplary embodiment in FIG. 11, this facilitates the insertion of a cable end 5 of the twin-lead cable into the winding support 905, In contrast to this, the winding supports 906 and 907 of the sixth and seventh exemplary embodiment have middle pieces 53 54 that are also closed in a ring shape in the region of the cut-outs, as is indicated by the shading of the middle pieces 53, 54 in FIG. 9. An insertion of cable ends 5 through the middle pieces 53, 54 is thus not possible. FIG. 12 schematically shows a three-dimensional view of a winding support 906 according to the sixth exemplary embodiment of the invention. A cable end 5 of the twin-lead cable is hereby initially inserted through the cut-outs 32, 33 of the two parts 23, 24, and the middle pieces 53, 54 (in the form of two halves 53*a*, 53*b* and 54*a*, 54*b*) are subsequently shifted from the outside along an infeed direction between the parts 23, 24 of the winding support 906. After the insertion of the middle pieces 53, 54, the remaining windings of the electrical coil can be wound by rotation of the winding support 906 around the winding axis 26.

Figure 13:
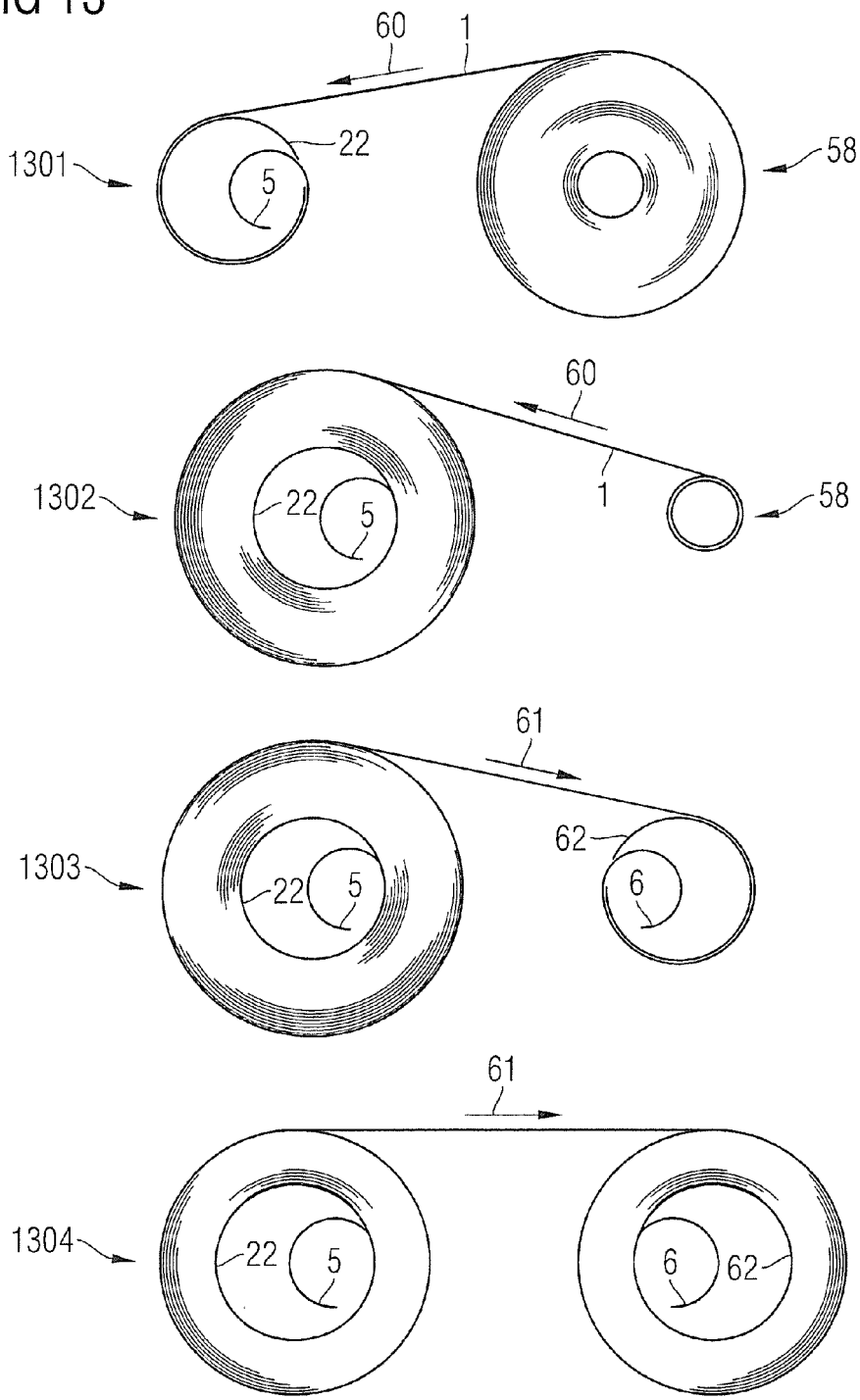
FIG. 13 schematically shows four sub-steps of a first production method according to the invention.

FIG. 13 shows four sub-steps of a first example of a production method of a superconducting coil in a schematic side view. In a first step 1301, a cable end 5 of a doubly contiguous superconducting twin-lead cable 1 is threaded into the slit of a winding support 22. In a second step, the largest part of the remaining twin-lead cable 1 is subsequently wound from a storage coil 58 onto the winding support 22 along a first winding direction 60. Two coil windings that are situated in parallel are thereby produced in the form of a double coil. To produce a second pair of coil windings (which second pair is symmetrical to the first pair) from the same twin-lead cable 1, in a third step 1303 the second cable end 6 is introduced into the slit of a second winding support 62. In a fourth step 1304, a part of the twin-lead cable 1 is subsequently wound back onto the second winding support 62 along a second winding direction 61. Two pairs of symmetrical sub-coils are thus obtained from a single superconducting twin-lead cable. In further method steps (not shown), the coil pairs are separated from one another via separation of the respective parts of the winding support, and every four sub-coils are arranged relative to one another so that magnetic fields generated by them upon current flow mutually reinforce. This occurs analogous to the rotation of the sub-coils counter to one another (shown in FIG. 8).

Figure 14:
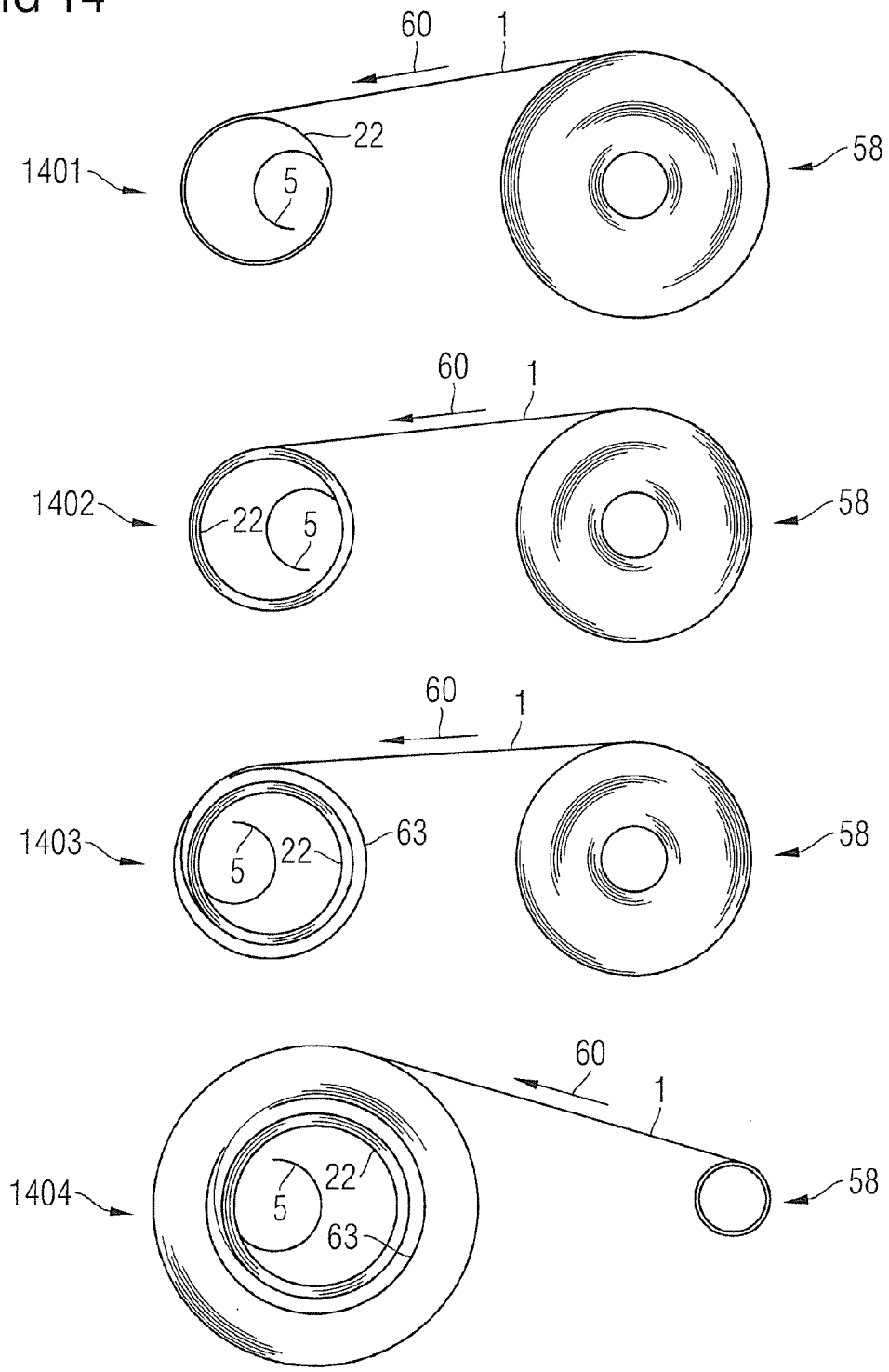
FIG. 14 schematically shows four sub-steps of a second production method according to the invention.

FIG. 14 schematically shows four sub-steps of a second example of a production method of a superconducting coil. The first step 1401 is identical to the first step of the first example in FIG. 13. In the second step 1402, however, only a portion of the doubly contiguous superconducting twin-lead cable 1 is wound on the first winding support. In the third step 1403, two parts of a third winding support 63 are placed on both sides around the twin-lead cable so that said twin-lead cable 1 subsequently proceeds through the slit of the third winding support 63. In the fourth step 1404, the majority of the remaining twin-lead cable 1 is wound from the storage coil 58 onto the third winding support. A superconducting coil with two pairs of symmetrical sub-coils is thus created, wherein the pairs have winding diameters that differ from one another. In this example, the sub-coils of the two pairs are separated from one another in additional steps (not shown here), and all individual coils are arranged relative to one another so that magnetic fields that are generated by the common twin-lead cable upon a flow of current mutually reinforce.

In a third example (not shown) of the production method, the two examples described in the preceding are combined with one another so that two coil pairs with different diameter are formed from each half of the twin-lead cable 1. The steps of the first and second exemplary embodiment are thus combined with one another so that a superconducting coil with four coil pairs is formed from two respective individual coils.

Although modifications and changes may be suggested by those skilled in the art, it is the intention of the inventor to embody within the patent warranted hereon all changes and modifications as reasonably and properly come within the scope of his contribution to the art.

I claim as my invention:

1. A winding support comprising:

at least two support parts configured to wind an electrical double coil in two parallel winding planes that are orthogonal to a winding axis;

each of said at least two parts having an annular structure comprising a base area, with the respective base areas of each of said at least two parts being identical to each other, and each base area being a band of an outer surface of a respective straight cylinder;

each of said at least two parts comprising at least one slit-shaped cut-out therein, extending in a longitudinal direction along said exterior of said straight cylinder; and said at least two parts being connectable so as to be adjacent to each other and laterally separated from each other along said winding axis, and with the respective cut-outs of said at least two parts aligned to form a common slit extending along all of said at least two parts.

2. A winding support as claimed in claim 1 wherein each of said slit-shaped cut-outs has two substantially parallel first boundary surfaces that are situated orthogonally to said winding planes and that form an angle of at most 20° with said exterior of said cylinder.

3. A winding support as claimed in claim 2 wherein said two boundary surfaces are curved surfaces that form an angle of at most 10° with respect to said exterior surface of said cylinder.

4. A winding support as claimed in claim 1 wherein each outer surface of each of said at least two parts is situated on an exterior surface of a common straight cylinder, having a base area with rotational symmetry with respect to two symmetry axes.

5. A winding support as claimed in claim 1 wherein said slit-shaped cut-out in at least one of said at least two parts extends along only a portion of the length of the respective exterior surface of the cylinder thereof.

6. A winding support as claimed in claim 1 wherein said at least two parts have respectively different extents in said direction of said winding axis.

7. A winding support as claimed in claim 1 wherein at least one of said at least two parts is connected with an annular end piece having a base area that is larger than said at least one part, and that is situated at a side of said at least one part facing away an adjacent part of said at least two parts.

8. A winding support as claimed in claim 1 wherein at least one of said at least two parts is connected with an annular middle piece having a base area that is larger than said one of said parts, and that is situated at a side of said one of said parts facing toward an adjacent part.

9. A winding support as claimed in claim 8 wherein said at least one middle part comprises a slit-shaped cut-out that, when said at least two parts are connected, forms a common slit extending over all of said parts.

10. An electrical coil comprising:

a winding support comprising at least two support parts configured to wind an electrical double coil in two parallel winding planes that are orthogonal to a winding axis, each of said at least two parts having an annular structure comprising a base area, with the respective base areas of each of said at least two parts being identical to each other, and each base area being a band of an outer surface of a respective straight cylinder, each of said at least two parts comprising at least one slit-shaped cut-out therein, extending in a longitudinal direction along said exterior of said straight cylinder, and said at least two parts being connectable so as to be adjacent to each other and laterally separated from each other along said winding axis, and with the respective cut-outs of said at least two parts aligned to form a common slit extending along all of said at least two parts;

a twin-lead cable having a doubly contiguous topology wound as a double coil comprised of two sub-coils, each having a same number of coil windings;

each of said sub-coils being attached to a respective one of said at least two parts of said winding support; and said two sub-coils being oriented with respect to each other to respectively produce mutually reinforcing magnetic fields when a current flows through said common twin-lead cable.

11. An electrical coil as claimed in claim 10 wherein said winding support is a first winding support, and comprising a second winding support, identical to said first winding support, on which said twin-lead cable is also wound identically to the winding of said twin-lead cable said first winding support.

12. An electrical coil as claimed in claim 10 wherein said twin-lead cable is a slit twin-lead cable with a contiguous superconducting layer.

13. A method to produce an electrical coil, comprising:

providing a winding support comprising at least two support parts, having an annular structure comprising a base area, with the respective base areas of each of said at least two parts being identical to each other, and each base area being a band of an outer surface of a respective straight cylinder, each of said at least two parts comprising at least one slit-shaped cut-out therein, extending in a longitudinal direction along said exterior of said straight cylinder, and said at least two parts being connected so as to be adjacent to each other and laterally separated from each other by a lateral separation along said winding axis, and with the respective cut-outs of said at least two parts aligned to form a common slit extending along all of said at least two parts;

wining two branches of a twin-lead cable having a doubly contiguous topology wound as a double coil comprised of two sub-coils on said winding support, each of said sub-coils having a same number of coil windings on the respective parts, with each of said sub-coils being attached to a respective one of said at least two parts of said winding support by introducing an end of said cable into said slit; and setting said lateral separation to cause said two sub-coils to be oriented with respect to each other to respectively produce mutually reinforcing magnetic fields when a current flows through said twin-lead cable.

14. A method as claimed in claim 13 wherein said end of said cable is a first end of said cable, and wherein said winding support is a first winding support, and comprising:

providing a second winding support identical to said first winding support;

after winding said two branches of said twin-lead cable onto said first winding support, introducing a second end of said cable, opposite to said first end, into the slit of said second winding support; and winding a portion of said cable onto said second winding support to form another pair of sub-coils on said second winding support also with said lateral separation causing said another two sub-coils to be oriented with respect to each other to respectively produce mutually magnetic fields when a current flows through said twin-lead cable.

15. A method as claimed in claim 13 comprising:

providing a third winding support identical to said first and second winding supports; and winding said twin-lead cable on said third winding support to produce a third pair of sub-coils that are also laterally separated with respect to each other to respectively produce mutually reinforcing magnetic fields when a current flows through said twin-lead cable.

* * * * *